US010347449B2

(12) United States Patent
Liu

(10) Patent No.: US 10,347,449 B2
(45) Date of Patent: Jul. 9, 2019

(54) POWER-ASSISTED MAGNETIC PROXIMITY SWITCH

(71) Applicants: FOSHAN Yif Technologies Co., Ltd., Foshan, Guangdong (CN); CHUANDONG MAGNETIC ELECTRONICS CO., LTD, Foshan, Guangdong (CN)

(72) Inventor: Li Liu, Guangdong (CN)

(73) Assignees: FOSHAN Yif Technologies CO., Ltd. (CN); CHUANDONG MAGNETIC ELECTRONIC CO., LTD. (CN)

( * ) Notice: Subject to any disclaimer, the term of this patent is extended or adjusted under 35 U.S.C. 154(b) by 64 days.

(21) Appl. No.: 15/736,226

(22) PCT Filed: Apr. 15, 2016

(86) PCT No.: PCT/CN2016/079457
§ 371 (c)(1),
(2) Date: Dec. 13, 2017

(87) PCT Pub. No.: WO2017/088344
PCT Pub. Date: Jun. 1, 2017

(65) Prior Publication Data

US 2018/0158631 A1 Jun. 7, 2018

(30) Foreign Application Priority Data

Nov. 24, 2015 (CN) ..... 2015 1 0824516

(51) Int. Cl.
*H01H 36/02* (2006.01)
*H01H 36/00* (2006.01)
*H01H 5/24* (2006.01)

(52) U.S. Cl.
CPC ..... *H01H 36/02* (2013.01); *H01H 5/24* (2013.01); *H01H 36/0046* (2013.01); *H01H 36/0073* (2013.01); *H01H 2205/002* (2013.01)

(58) Field of Classification Search
CPC ..... H01H 36/00; H01H 36/02; H01H 36/0073
See application file for complete search history.

(56) References Cited

U.S. PATENT DOCUMENTS 6,069,331 A * 5/2000 Utke ..... H01H 35/40 200/84 C

* cited by examiner

*Primary Examiner* — Ramon M Barrera

(57) ABSTRACT

A power-assisted magnetic proximity switch comprises a shell; the inner chamber of the shell is provided with a magnet, a first terminal and a second terminal; the first terminal and the second terminal are disposed in parallel at intervals, and each terminal vertically penetrates into the lower end plate of the shell; the upper end of the second terminal is transversely provided with an elastic contact piece; the free end of the elastic contact piece is disposed above the first terminal; a power-assisted rod is disposed in the shell, and the outer end of the power-assisted rod is hinged with the shell; an elastic tongue piece is disposed on the elastic contact piece.

8 Claims, 4 Drawing Sheets

POWER-ASSISTED MAGNETIC PROXIMITY SWITCH

TECHNICAL FIELD OF THE INVENTION

The present invention relates to the technical field of proximity switches, and more particularly, to a power-assisted magnetic proximity switch.

BACKGROUND OF THE INVENTION

A magnetic proximity switch is a proximity sensor that uses a magnetic element to detect the position variation of nearby objects, and is capable of converting the non-electrical quantities or electromagnetic quantities into required electrical signals, thereby achieving the controlling and measuring purposes. Specifically, in the field of robot application technologies, automatic navigation and positioning detection are crucial for achieving an intelligent control. Compared with commonly-used controllers, proximity switches possess significant advantages in positioning detection and execution control. Due to the high performances of target detection and safety control, magnetic proximity switches are widely applied in various industries such as magnetic-fuse bomb heads, magnetic-detection underwater mines, spacecraft magnetic-flux-gate, high-speed trains, automatic elevators, thermo-magnetic power generation systems, automatic processing equipments, automobile speed control systems, automobile skylight control systems, door switches, cover opening and closing mechanisms and pressure detection devices, etc.

Chinese patent CN201410299835.1 discloses a novel magnetic proximity switch that comprises a shell, a magnet capable of moving upward and downward within the upper portion of the shell, and two wiring terminal pieces that are disposed at the bottom of the shell in parallel, wherein the upper end of one wring terminal piece is provided with an elastic piece, the middle portion of the shell is provided with a swing-able power-assisted rod and a limiting mechanism that interacts with the power-assisted rod, and the elastic piece is provided with an elastic tongue piece that abuts against the power-assisted portion of the power-assisted rod. Although this design can solve problems, such as the metal fatigue of the elastic tongue piece that is caused by a large travel range of the power-assisted rod and the magnet in the motion mechanism, the swing fulcrum of the power-assisted rod, the power-assisted portion and the moment fulcrum of the elastic tongue piece are located on the same horizontal line, and the force arm between the moment fulcrum and the swing fulcrum is long. Thus, a large ratio between the travel range of one end of the power-assisted rod in the limiting mechanism and the swing range of the power-assisted portion is established, resulting in a low moment conversion efficiency of the power-assisted rod and a poor power-assisted travel effect. The magnet moves upward and downward, thereby propelling the power-assisted rod to swing. Thus, the elastic piece is further propelled to move. Due to the friction existing among the magnet, the shell and the power-assisted rod, the magnet powder or the electroplating layer provided on the components can be easily abraded-off, seriously affecting the reliability of the electrical connection between the contacts of the elastic piece and the wiring terminal piece. Furthermore, although the moment conversion of the power-assisted rod ensures a stable control of the switching-on/off of the large current, the arcing problem occurring between the contacts during the variation of the current load cannot be solved. Furthermore, due to the surface oxidation of the contacts and the metal components, the operating stability and the function life of the products can be seriously affected.

In conclusion, the shortcomings of traditional magnetic proximity switches are urgent problems that need to be solved for those skilled in this field.

SUMMARY OF THE INVENTION

The purpose of the present invention is to solve the shortcomings in the prior art and provide a stable and reliable power-assisted magnetic proximity switch having a compact structure.

To achieve the above purpose, the present invention adopts the following technical solution:

A power-assisted magnetic proximity switch comprises a shell; the inner chamber of the shell is provided with a magnet, a first terminal and a second terminal; the first terminal and the second terminal are disposed in parallel at intervals, and each terminal vertically penetrates into the lower end plate of the shell; the upper end of the second terminal is transversely provided with an elastic contact piece; the free end of the elastic contact piece is disposed above the first terminal; a power-assisted rod is disposed in the shell, and the outer end of the power-assisted rod is hinged with the shell; an elastic tongue piece is disposed on the elastic contact piece; the free end of the elastic tongue piece abuts against the inner end of the power-assisted rod; the outer end of the power-assisted rod is provided with a limiting insertion plate that forms an L-shaped structure with the power-assisted rod; a limiting mechanism, which interacts with the limiting insertion plate, is disposed in the shell; the upper side surface of the free end of the power-assisted rod is provided with a holding tray; the magnet is disposed between the holding tray and the upper end plate of the shell, and is fixed to the holding tray.

In another aspect of the present invention, the upper end surface of the holding tray is provided with a mounting port. The lower end of the magnet penetrates through the mounting port and is in an interference fit with the mounting port.

In another aspect of the present invention, when the height difference between the bottom surface of the mounting port and the upper end surface of the holding tray is defined as "A", and the height of the magnet is defined as "H", the ratio of A to H is within a range of 0.2-1.

In another aspect of the present invention, the inner wall of the shell, which is located above the first terminal, is provided with a fulcrum, and the outer end of the power-assisted rod is provided with a lantern ring. The lantern ring is sleeved on the fulcrum, and is in a running fit with the fulcrum. The limiting insertion plate is disposed on the lantern ring. The limiting insertion plate, the lantern ring and the power-assisted rod form an integrated L-shaped structure.

In another aspect of the present invention, the limiting mechanism comprises two limiting plates that are oppositely disposed at intervals. The two limiting plates are disposed above the fulcrum. A straight slot is provided between the two limiting plates, and the opening of the straight slot faces the fulcrum. The limiting insertion plate movably penetrates into the straight slot located between the two limiting plates.

In another aspect of the present invention, when the distance between the inner side surfaces of the two limiting plates is defined as "D", and the thickness of the limiting insertion plate is defined as "S", the ratio of D to S is within a range of 1.1-1.9. When the travel angle formed by the magnet that rotates along the power-assisted rod is defined as "P", P is in direct proportion to the ratio of D to S.

In another aspect of the present invention, a transverse hinge is disposed at the upper end of the first terminal, and the hinge is provided with a stationary contact. The free end of elastic contact piece is disposed above the hinge, and the elastic contact piece is provided with a movable contact that interacts with the stationary contact.

In another aspect of the present invention, the inner side wall of the shell that is located between the hinge and the power-assisted rod is provided with a J-shaped arc-guiding strip. The arc-guiding strip is transversely disposed, and the hook portion of the J-shaped arc-guiding strip is disposed to correspond to the movable contact.

Compared with the prior art, the present invention has the following advantages:

The present invention has a reasonable structure. Through the interaction between the limiting insertion plate and travel distance of the limiting mechanism, the travel angle between the power-assisted rod and the magnet can be controlled. Thus, when the magnet moves downwards to the lower travel limit, the elastic tongue piece keeps providing an upward reset moment to the power-assisted rod, thereby increasing the reset force of the elastic tongue piece when the contacts are separated. The magnet integrally rotates with the power-assisted rod within a holding tray, thereby protecting the reliability of the electrical connection from being affected by the magnet powder abraded-off from the magnet. Meanwhile, the present invention is provided with an arc-guiding slot structure for protecting the separation of contacts, through which the arcing problem can be prevented from affecting the insulation shell and the components. Thus, the operating stability of the proximity switch can be improved, and the functional life can be prolonged.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1、Shell; 2、Elastic Contact Piece; 3、Power-assisted Rod; 4、Magnet; 11、The First Terminal; 12、The Second Terminal; 13、Fulcrum; 14、Stationary Contact; 15、Limiting Plate; 16、Hinge; 17、Arc-guiding Strip; 21、Elastic Tongue Piece; 22、Movable Contact; 31、Limiting Insertion Plate; 32、Lantern Ring; 33、Holding Tray; 34、Mounting Port.

DETAILED DESCRIPTION OF THE INVENTION

Drawings and detailed embodiments are combined hereinafter to elaborate the technical principles of the present invention.

Figure 1:
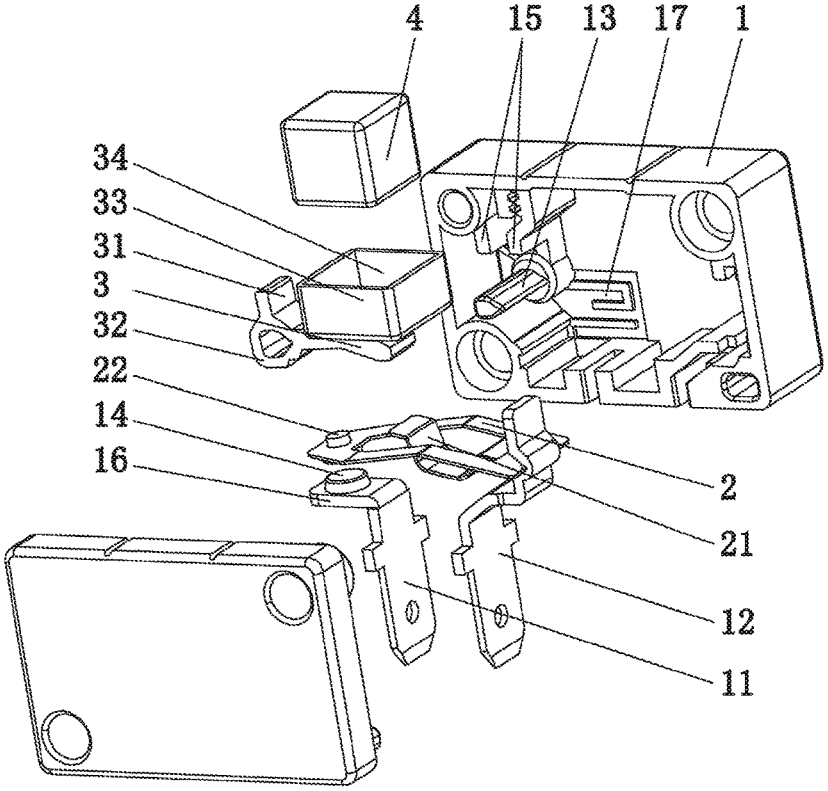
FIG. 1 is an explosive view of the present invention.
Figure 2:
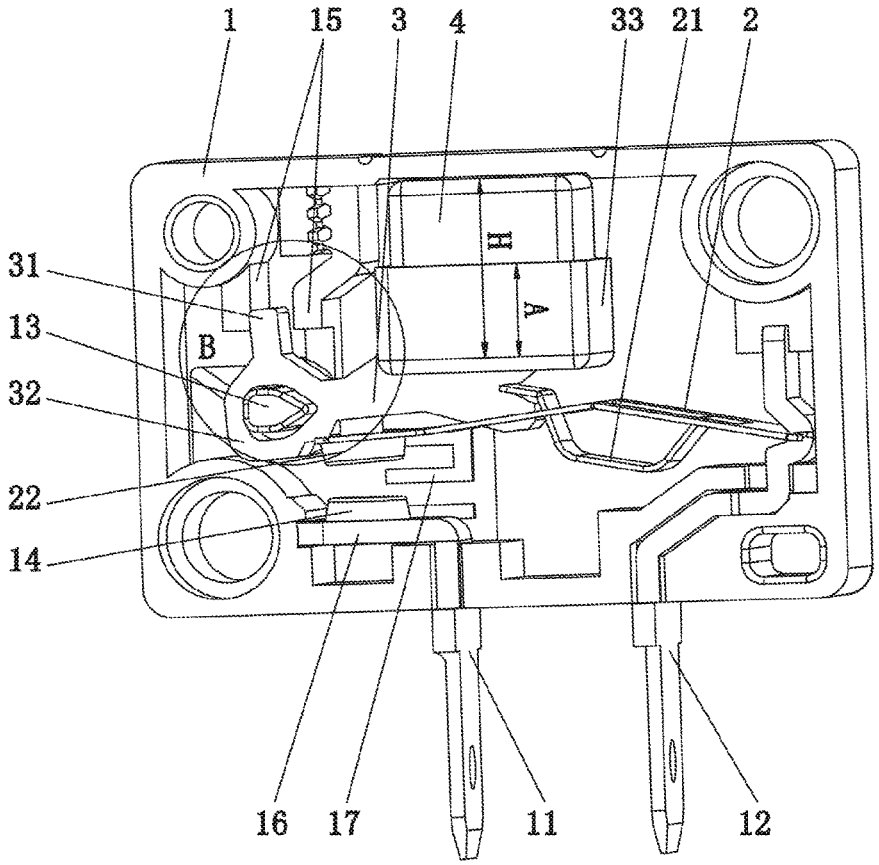
FIG. 2 is a schematic diagram illustrating the internal assembly structure of the present invention.
Figure 3:
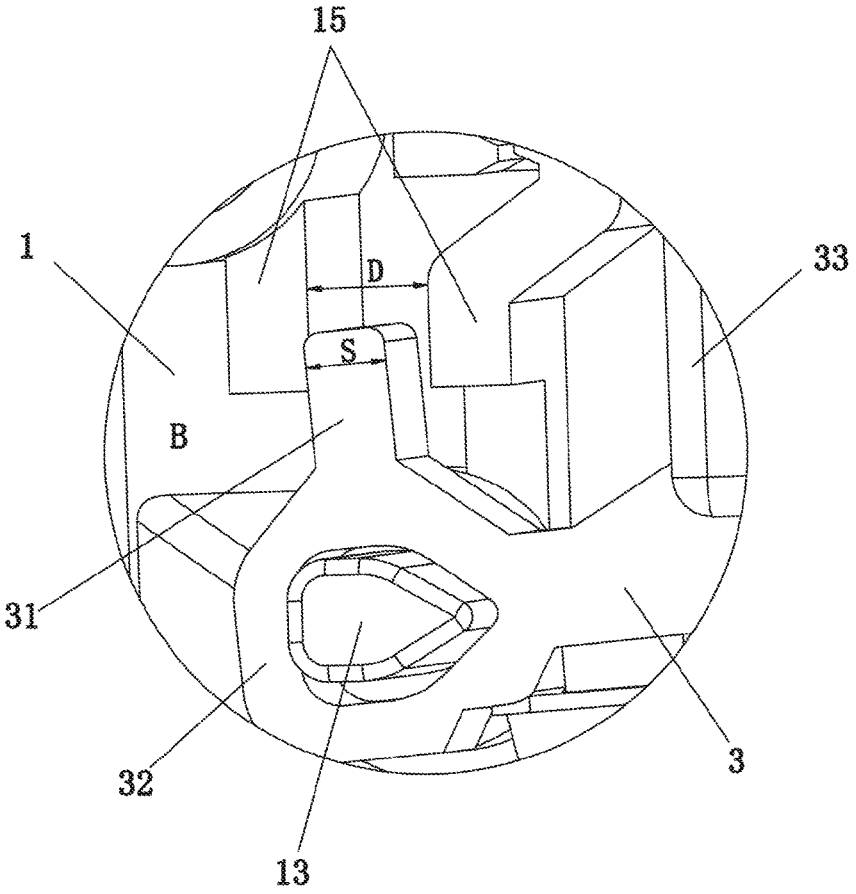
FIG. 3 is an enlarged structural diagram of part B in FIG. 2.

As shown in FIGS. 1-3, the power-assisted magnetic proximity switch of the present invention comprises a shell 1. The inner chamber of the shell 1 is provided with a magnet 4, a first terminal 11 and a second terminal 12. The first terminal 11 and the second terminal 12 are disposed in parallel at intervals, and each terminal is vertically inserted into the lower end plate of the shell 1. The upper end of the second terminal 12 is transversely provided with an elastic contact piece 2. The free end of the elastic contact piece 2 is disposed above the first terminal 11. A power-assisted rod 3 is disposed in the shell, and the outer end of the power-assisted rod 3 is hinged with the shell 1. An elastic tongue piece 21 is disposed on the elastic contact piece 2. The free end of the elastic tongue piece 21 abuts against the inner end of the power-assisted rod 3. The magnet 4 propels the power-assisted rod 3 to move, and this enables the elastic contact piece 2 to switch-on the circuit between the first terminal 11 and the second terminal 12. The moment of the elastic tongue piece 21 and the power-assisted rod 3 provide a reset force to the elastic contact piece, thereby achieving a stable control of the switching-on/off of the proximity switch. As the operating principle is similar to the prior art, it is briefly described herein.

The outer end of the power-assisted rod 3 is provided with a limiting insertion plate 31 that forms an L-shaped structure with the power-assisted rod 3. A limiting mechanism that interacts with the limiting insertion plate 31 is disposed in the shell 1. The outer end of the power-assisted rod 3 is hinged with the shell 1, thereby allowing the inner end of the power-assisted rod 3 to swing upward and downward. The limiting insertion plate 31 that is configured in an "L" shape interacts with the limiting mechanism to define the upper and lower swing limits of the power-assisted rod 3. In order to conveniently describe the moment variation of the power-assisted rod 3, the point where the outer end of the power-assisted rod 3 and the shell 1 are hinged is defined as "M", the point where the inner end of the power-assisted rod 3 and the elastic tongue piece are connected is defined as "N", and the point where the elastic contact piece 2 and the second terminal 12 are connected is defined as "K". The connecting lines between the points M, N and K form a triangle moment relation, wherein the inner angle of the point N is an obtuse angle, and the height of the triangle that corresponds to the point N is defined as "H". When the power-assisted rod 3 reaches the upper limit, namely, when the power-assisted rod 3 is in an initial switching-off state, H is the maximum value, and the moment generated by the elastic tongue piece 21 that is located on the connecting line between the points K and N provides an upward supporting force to the point N of the power-assisted rod. When the magnet 4 propels the point N of the power-assisted rod 3 to rotate downwards to reach a lower limit, H is the minimum value and is greater than 0. Thus, the elastic contact piece 2 is in a switching-on state, and the elastic tongue piece 21 still imposes an upward reset moment on the power-assisted rod 3. As a result, after the magnet 4 is released, the elastic tongue piece 21 can provide a large reset torque force, thereby ensuring a high sensitivity of the switching-off of the proximity switch.

The upper side surface of the free end of the power-assisted rod 3 is provided with the holding tray 33, and the magnet 4 is disposed between the holding tray 33 and the upper end plate of the shell 1. The magnet 4 is fixed to the holding tray 33. The magnet 4 integrally rotates with the power-assisted rod 3 within a holding tray 33, thereby protecting the reliability of the electrical connection from being affected by the magnet powder abraded-off from the magnet.

The upper end surface of the holding tray 33 is provided with a mounting port 34. The lower end of the magnet 4 penetrates through the mounting port 34, and is in an interference fit with the mounting port 34. The magnet 4 is fixed to the holding tray 33 through the mounting port 34. The holding tray 33 and the power-assisted rod 3 are made from an insulating material, and are integrally machined. Thus, the assembly efficiency and the relative position accuracy can be improved.

When the height difference between the bottom surface of the mounting port 34 and the upper end surface of the holding tray 33 is defined as "A", and the height of the magnet 4 is defined as "H", the ratio of A to H is within a range of 0.2-1. The magnet 4 can be partially or completely assembled with the holding tray 33, and the connection strength between the magnet 4 and the holding tray 33 varies along the ratio of A to H. The contact surface between the magnet 4 and the holding tray 33 is provided with a magnetism-isolating material. Alternatively, the holding tray 33 can be made from a magnetism-isolating material. Therefore, the magnetic-induction driving control in a single direction can be realized in various operating environments.

The inner wall of the shell 1, which is located above the first terminal 11, is provided with a fulcrum 13, and the outer end of the power-assisted rod 3 is provided with a lantern ring 32. The lantern ring 32 is sleeved on the fulcrum 13, and is in a running fit with the fulcrum 13. The limiting insertion plate 31 is disposed on the lantern ring 32. The limiting insertion plate 31, the lantern ring 32 and the power-assisted rod 3 form an integrated L-shaped structure.

The limiting mechanism comprises two limiting plates 15 that are oppositely disposed at intervals. The two limiting plates 15 are disposed above the fulcrum 13, and a straight slot is formed between the two limiting plates. The opening of the straight slot faces the fulcrum 13. The limiting insertion plate is movably inserted in to the straight slot located between the two limiting plates. The limiting insertion plate 31 swings leftward and rightward between the two limiting plates, and the limiting insertion plate 31 are integrally molded with the power-assisted rod 3. Thus, the upper and lower swing limits of the inner end of the power-assisted rod 3 can be controlled. The L-shaped configuration can effectively improve the utilization rate of the inner space of the shell 1 so that the overall volume can be reduced and the spatial arrangement can be more reasonable. The magnet 4 rotates upward and downward along the power-assisted rod 3 within the holding tray 33, thereby achieving a precise control of the rotation angle of the magnetic line of the magnet 4 through calculating and controlling the distance between the two limiting plates 15.

Figure 4:
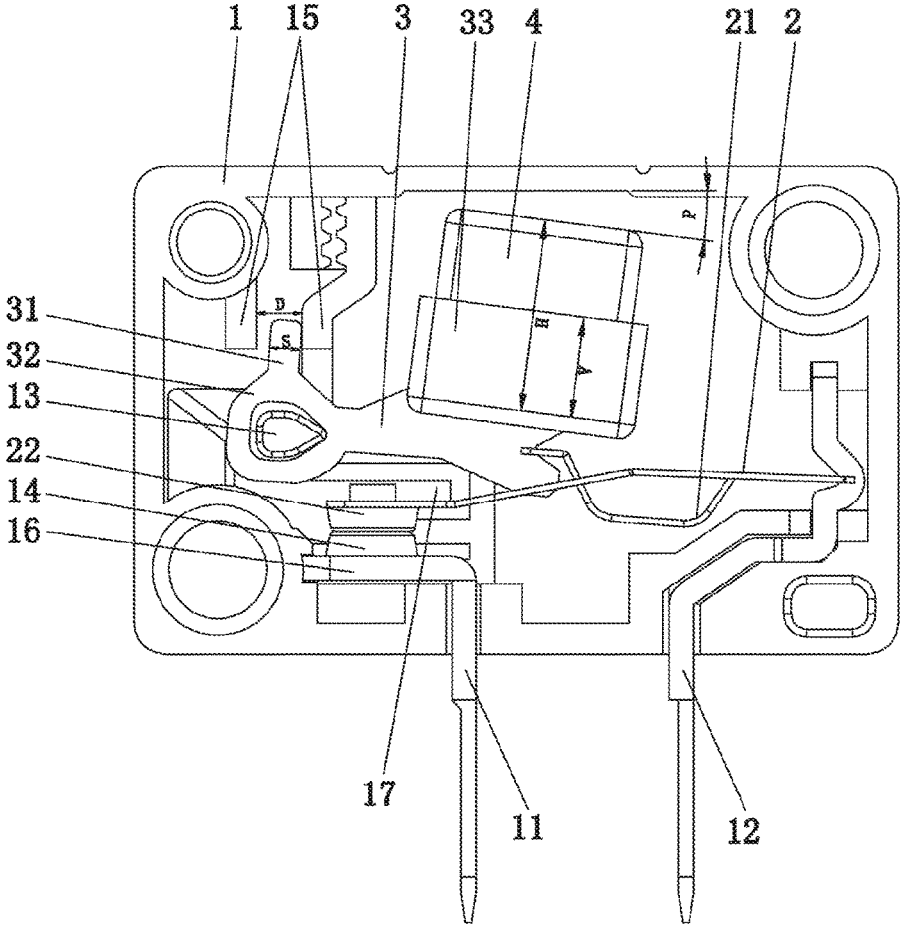
FIG. 4 is a schematic diagram illustrating an internal plane structure when the present invention is in a switched-on state.

As shown in FIG. 4, when the distance between the inner side surfaces of the two limiting plates is defined as "D", and the thickness of the limiting insertion plate is defined as "S", the ratio of D to S is within a range of 1.1-1.9. When the travel angle formed by the magnet 4 that rotates along the power-assisted rod 3 is defined as "P", P is in direct proportion to the ratio of D to S. During the switching-on/off process, the travel angle P formed by the magnet 4 that rotates relative to the upper end plate of the shell 1 is controlled by the ratio of D to S, and the ratio of D to S enables the travel angle P to be within a range of 1-20°. The ratio of D to S is preferably within a range of 1.3-1.7, and the travel angle of the magnet 4 is preferably with a range of 5-15°.

A transverse hinge 16 is disposed at the upper end of the first terminal 11, and the hinge 16 is provided with a stationary contact 14. The free end of elastic contact piece 2 is disposed above the hinge 16, and the elastic contact piece 2 is provided with a movable contact 22 that interacts with the stationary contact 14. The inner side wall of the shell 1 that is located between the hinge 16 and the power-assisted rod 3 is provided with a J-shaped arc-guiding strip 17. The arc-guiding strip 17 is transversely disposed, and the hook portion of the J-shaped arc-guiding strip 17 is disposed to correspond to the movable contact 22. The control range of the arc-guiding strip 17 is matched with the motion range of the movable contact 22, thus preventing the arcing problem that occurs in the switching-on/off process of the movable contact 22 and the stationary contact 14 from affecting the shell 1 and other internal components. Thus, the operating stability and the functional life of the overall structure can be greatly improved.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A power-assisted magnetic proximity switch, comprising:

a shell, wherein the inner chamber of the shell is provided with a magnet, a first terminal and a second terminal, wherein the first terminal and the second terminal are disposed in parallel at intervals, and each terminal vertically penetrates into the lower end plate of the shell, wherein the upper end of the second terminal is transversely provided with an elastic contact piece, wherein the free end of the elastic contact piece is disposed above the first terminal, wherein a power-assisted rod is disposed in the shell, and the outer end of the power-assisted rod is hinged with the shell, wherein an elastic tongue piece is disposed on the elastic contact piece, wherein the free end of the elastic tongue piece abuts against the inner end of the power-assisted rod, wherein the outer end of the power-assisted rod is provided with a limiting insertion plate that forms an L-shaped structure with the power-assisted rod, wherein a limiting mechanism, which interacts with the limiting insertion plate, is disposed in the shell, wherein the upper side surface of the free end of the power-assisted rod is provided with a holding tray, wherein the magnet is disposed between the holding tray and the upper end plate of the shell, and is fixed to the holding tray.

2. The power-assisted magnetic proximity switch of claim 1, wherein the upper end surface of the holding tray is provided with a mounting port, wherein the lower end of the magnet penetrates through the mounting port and is in an interference fit with the mounting port.

3. The power-assisted magnetic proximity switch of claim 2, wherein when the height difference between the bottom surface of the mounting port and the upper end surface of the holding tray is defined as "A", and the height of the magnet is defined as "H", the ratio of A to H is within a range of 0.2-1.

4. The power-assisted magnetic proximity switch of claim 1, wherein the inner wall of the shell, which is located above the first terminal, is provided with a fulcrum, and the outer end of the power-assisted rod is provided with a lantern ring, wherein the lantern ring is sleeved on the fulcrum, and is in a running fit with the fulcrum, wherein the limiting insertion plate is disposed on the lantern ring, wherein the limiting insertion plate, the lantern ring and the power-assisted rod form an integrated L-shaped structure.

5. The power-assisted magnetic proximity switch of claim 4, wherein the limiting mechanism comprises two limiting plates that are oppositely disposed at intervals, wherein the two limiting plates are disposed above the fulcrum, wherein a straight slot is provided between the two limiting plates, and the opening of the straight slot faces the fulcrum, wherein the limiting insertion plate movably penetrates into the straight slot located between the two limiting plates.

6. The power-assisted magnetic proximity switch of claim 5, wherein when the distance between the inner side surfaces of the two limiting plates is defined as "D", and the thickness of the limiting insertion plate is defined as "S", the ratio of D to S is within a range of 1.1-1.9, wherein when the travel angle formed by the magnet that rotates along the power-assisted rod is defined as "P", P is in direct proportion to the ratio of D to S.

7. The power-assisted magnetic proximity switch of claim 1, wherein a transverse hinge is disposed at the upper end of the first terminal, and the hinge is provided with a stationary contact, wherein the free end of elastic contact piece is disposed above the hinge, and the elastic contact piece is provided with a movable contact that interacts with the stationary contact.

8. The power-assisted magnetic proximity switch of claim 7, wherein the inner side wall of the shell that is located between the hinge and the power-assisted rod is provided with a J-shaped arc-guiding strip, wherein the arc-guiding strip is transversely disposed, and the hook portion of the J-shaped arc-guiding strip is disposed to correspond to the movable contact.

* * * * *